US008465600B2

(12) United States Patent
Watanabe et al.

(10) Patent No.: US 8,465,600 B2
(45) Date of Patent: Jun. 18, 2013

(54) HIGH-STRENGTH STEEL SHEET HAVING EXCELLENT WORKABILITY

(75) Inventors: Seiko Watanabe, Kakogawa (JP); Masaaki Miura, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 413 days.

(21) Appl. No.: 12/278,204

(22) PCT Filed: Mar. 16, 2007

(86) PCT No.: PCT/JP2007/055396

§ 371 (c)(1),
(2), (4) Date: Aug. 4, 2008

(87) PCT Pub. No.: WO2007/111164

PCT Pub. Date: Oct. 4, 2007

(65) Prior Publication Data

US 2009/0056836 A1 Mar. 5, 2009

(30) Foreign Application Priority Data

Mar. 28, 2006 (JP) ..... 2006-089052

(51) Int. Cl.
*C22C 38/22* (2006.01)
*C22C 38/12* (2006.01)

(52) U.S. Cl.
USPC ..... 148/334; 148/320; 420/110; 420/111; 420/118; 420/120; 420/124

(58) Field of Classification Search
USPC ..... 148/320–337, 405; 420/120, 123, 420/124, 126, 127, 129, 8, 104–118
IPC ..... C22C 38/12,38/22
See application file for complete search history.

(56) References Cited

U.S. PATENT DOCUMENTS

| | | | | |
|---|---|---|---|---|
| 6,290,784 | B1 * | 9/2001 | Yasuhara et al. | 148/320 |
| 2001/0027831 | A1 * | 10/2001 | Toyooka et al. | 148/333 |
| 2004/0226635 | A1 * | 11/2004 | Ikeda et al. | 148/649 |

FOREIGN PATENT DOCUMENTS

| | | | |
|---|---|---|---|
| EP | 1 514 951 | A1 | 3/2005 |
| EP | 1 674 586 | A1 | 6/2006 |

(Continued)

OTHER PUBLICATIONS

G.T. Park, S.U. Koh, H.G. Jung, K.Y. Kim, "Effect of microstructure on the hydrogen trapping efficiency and hydrogen induced cracking of linepipe steel," Corrosion Science, 50 (2008), pp. 1865-1871, available online May 1, 2008.*

(Continued)

*Primary Examiner* — Scott Kastler
*Assistant Examiner* — Vanessa Luk
(74) *Attorney, Agent, or Firm* — Oblon, Spivak, McClelland, Maier & Neustadt, L.L.P.

(57) ABSTRACT

According to the present invention, there is provided a high strength steel sheet, which has, for example, a tensile strength of 590 to 980 MPa or more, which has favorable workability, and which is useful for an automobile, etc. The high strength steel sheet of the present invention comprises 0.03 to 0.20% C (% by mass in chemical compositions; hereafter, the same holds true), 0.50 to 2.5% Si, 0.50 to 2.5% Mn, and further, preferably 0.02 to 0.2% Mo. Moreover, its metal structure includes ferrite and low temperature transformation phase. The mean grain size of the low temperature transformation phase is 3.0 μm or less. Further, grains whose size is 3.0 μm or less occupy 50% or more by area ratio of the low temperature transformation phase, and an average aspect ratio of the low temperature transformation phase is 0.35 or more.

15 Claims, 2 Drawing Sheets

FOREIGN PATENT DOCUMENTS

| | | |
|---|---|---|
| JP | 4-99227 | 3/1992 |
| JP | 11 189839 | 7/1999 |
| JP | 2000 17385 | 1/2000 |
| JP | 2004 238679 | 8/2004 |
| JP | 2005 29867 | 2/2005 |
| JP | 2005 213603 | 8/2005 |
| JP | 2005 273002 | 10/2005 |
| WO | 03 106723 | 12/2003 |

OTHER PUBLICATIONS

U.S. Appl. No. 13/635,696, filed Sep. 18, 2012, Ikeda, et al.

* cited by examiner

HIGH-STRENGTH STEEL SHEET HAVING EXCELLENT WORKABILITY

TECHNICAL FIELD

The present invention relates to a high strength steel sheet which is excellent in workability, which has a tensile strength of, for example, 590 to 980 MPa or more, and which is useful for an automobile etc.

BACKGROUND ART

In recent years, for the purpose of reducing fuel consumption by achieving weight reduction of automobile and ensuring safety for occupants of automobile at the time of a collision, demand for a high strength steel sheet has been increasing. Accordingly, there are growing needs for a high strength of more than conventional 590 MPa to 980 MPa for use in a structural member of automobile, such as a member or a pillar for absorbing energy at the time of a collision. Also, lately, there has been a strong demand for improvement in an antirust property. Therefore, in order to provide both the high strength and antirust property, demand for the galvanized high-strength steel sheet is also growing.

Furthermore, when applying such a steel sheet to an automobile, not only the strength and antirust property but also workability while forming a structural member of the automobile is also an important required characteristic. However, there exists a trade-off between the strength and workability for forming the structural member, and an increase in strength is at the same time accompanied by degradation of workability.

Under the circumstances, in order to improve workability while increasing strength of a steel sheet, a method has been developed such that a composite structure is obtained by transforming austenite into martensite through control of a cooling pattern after heating to a dual phase of ferrite and austenite. Such a composite-structure steel sheet can also be manufactured in a continuous annealing line.

For example, Patent document 1 discloses a method to produce a steel sheet of a composite structure including ferrite and martensite, with which the steel sheet of high workability and high strength is obtained. Moreover, according to Patent document 2, a galvanized steel sheet excellent in terms of strength, anti-aging, and ductility is obtained by specifying the volume rate and grain size of the martensite in the composite structure of ferrite and martensite, a production site and a dispersion state of the martensite, and dispersion intervals.

However, according to Patent document 1, a hot-rolled steel plate is heated at the temperature of 600° C. or more but below $Ac_1$ point and pickling is performed before the recrystallization annealing and tempering treatment are performed, which brings about actual problems of decrease in productivity and increase in cost due to the additional process of heating.

Further, according to Patent document 2, the amount of C contained in a steel material to be used is set to 0.005 to 0.04%. However, when the contained amount of C decreases, martensite for obtaining high strength decreases, so that the strength of 590 MPa or more cannot be obtained. According to Patent document 2, when a large amount of Mo is added as an element for reinforcement, a certain high strength is obtained. However, an increase in material cost is inevitable.

Patent document 1: JP-A No. 2005-213603

Patent document 2: JP-A No. 2005-29867

DISCLOSURE OF THE INVENTION

Problem to be Solved by the Invention

The present invention is made in consideration of the above prior art, and its object is to provide a high strength steel sheet, which has a tensile strength of 590 MPa or more and, further, 980 MPa or more being useful for a structural member of automobile, and which has high workability, without adding a large amount of expensive alloy elements such as Mo.

Means for Solving the Problem

In order to solve the above problems, a high strength steel sheet of the present invention comprises 0.03 to 0.20% C (% by mass in chemical compositions; hereafter, the same holds true), 0.50 to 2.5% Si, and 0.50 to 2.5% Mn. Further, its metal structure includes ferrite and low temperature transformation phase. The mean grain size of the low temperature transformation phase is 3.0 μm or less. Also, grains whose grain size is 3.0 μm or less occupy 50% or more by area ratio of the low temperature transformation phase. Further, an average aspect ratio of the low temperature transformation phase is 0.35 or more.

Depending on required characteristics, the above steel material of the present invention may contain 0.02 to 0.2% Mo. Alternatively, it is effective to contain at least one element selected from the group consisting of: 0.01 to 0.15% Ti; 0.01 to 0.15% Nb; 0.01 to 0.5% Cr; and 0.001 to 0.15% V.

EFFECT OF THE INVENTION

According to the present invention, chemical compositions of the steel material are specified as above. Also, the metal structure is provided as a composite structure including ferrite and low temperature transformation phase. In particular, by minimizing the size of the low temperature transformation phase and by allowing the mean value of the aspect ratio defined by the ratio of short diameter/long diameter to be 0.35 or more, a steel sheet with high workability can be provided at a comparatively low cost while meeting the demand for raising the strength.

BEST MODE FOR CARRYING OUT THE INVENTION

Figure 1:
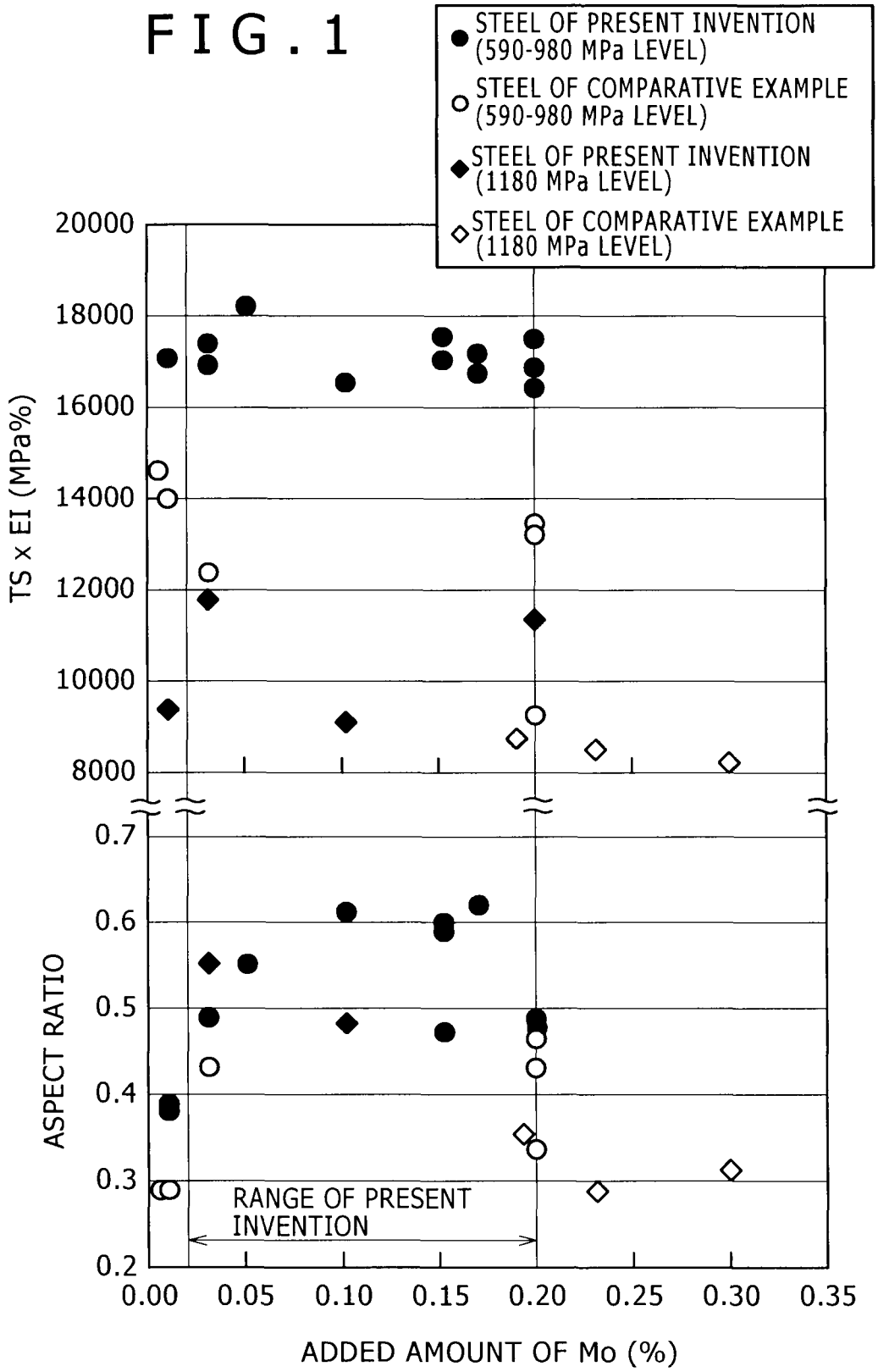
FIG. 1 is a graph showing an effect given by addition of the amount of Mo to the balance of tensile strength and elongation (TS×El) of a test steel material and the aspect ratio of the low temperature transformation phase.

In view of the above problems to be solved, the present inventors focused on the composite-structure steel sheet. In order to improve both the strength and workability, the inventers put a chief aim on chemical compositions and metal structure of the steel material, especially, on a form of the low temperature transformation phase, and repeated the studies for improvement to arrive at the present invention.

While clarifying hereafter the chemical compositions of the steel materials specified in the present invention and the reason for setting the metal structure, a useful method for obtaining the metal structure will further be described.

First, the reason for having specified the chemical compositions of the steel materials will be explained.

C: 0.03% or more to 0.20% or less

C is an important element for securing strength. Also, it changes the amount and form of the low temperature transformation phase. Further, it influences the elongation and hole-expanding property being factors for workability. If the C content is less than 0.03%, it becomes difficult to secure strength of 590 MPa or more. On the other hand, an excessive amount of C content deteriorates the workability and spot-weldability. Therefore, it should be suppressed to at most 0.20% or less. The C content is preferably 0.05% or more to 0.17% or less.

Si: 0.50 to 2.5%

Si acts effectively as a solid solubility reinforcing element. Further, as the amount of Si content increases, it increases the volume fraction of ferrite. Still further, Si is effective in enhancing ductility as well as strength of a composite-structure type steel sheet including ferrite and martensite. Such an effect is sufficiently exhibited when the amount of Si is 0.50% or more. However, when Si is excessively contained, Si scale amount increases at the time of hot-rolling to deteriorate the surface quality of the steel sheet and to affect the conversion treatment. Therefore, the amount of Si must be suppressed to 2.5% or less. The preferable amount of Si content is 0.7% or more to 1.8% or less.

Mn: 0.50 to 2.5%

Mn stabilizes austenite at the time of soaking in a continuous annealing line. Further, it has a remarkable effect on the characteristics of the low temperature transformation phase generated in a cooling process. Also, it is an element indispensable to strengthen ferrite as a solid solubility strengthening element. Therefore, the amount of Mn contained may be set to at least 0.50% or more and, more preferably, 0.60% or more. However, if the amount is excessive, it becomes difficult to melt and refine the steel. Also, it remarkably affects the workability and spot-weldability. Therefore, the amount should be suppressed to at most 2.5% or less and, more preferably, 2.3% or less.

The main components of the steel materials of the present invention are above-described C, Si, and Mn. The remainder are substantially iron, iron source (iron ore etc.), and supplementary materials (deoxidation material etc.) at the time of melting. Also, the remainder includes inevitable impurities being mixed during scrapping etc. To be specific, they are P, S, Al, and N. All of these act as non-metal system mediating sources and affect the strength and workability. Therefore, the amount of inevitable impurities should generally be suppressed to about 0.02% P or less, about 0.005% S or less, about 0.1% Al or less, and about 0.01% N or less.

According to the present invention, both the strength and workability are achieved by basically controlling the metal structure to be described later by use of the steel of the above compositions. More preferably, however, in order to enhance strength, proper amount of following reinforcement elements can be contained.

Mo: 0.02 to 0.20%

Mo is an element which improves hardening characteristics and urges generation of a low temperature transformation phase which is useful for enhancing strength, and its effect is exhibited by adding the amount of 0.02% or more. However, according to the present invention, the addition effect is exhibited in the range of up to 0.20%. Even if Mo is added more than that, the effect is saturated, causing a cost rise and deteriorating the workability. Therefore, the amount of Mo should be suppressed to 0.20% or less and, more preferably, 0.18% or less.

At least one element selected from the group consisting of 0.01 to 0.15% Ti, 0.01 to 0.15% Nb, 0.01 to 0.5% Cr, and 0.001 to 0.15% V.

These elements are the ones having the same effects in terms of enhancing the strength of the steel. In particular, Ti acts to form precipitates such as a carbide and a nitride and to reinforce the steel. At the same time, Ti makes crystal grains finer and raises yield strength. Furthermore, it dissolves in small quantities in ferrite, and acts to suppress bainite transformation during a cooling process. These actions are effectively exerted by adding 0.01% Ti or more (preferably, while satisfying the inequality Ti>4N in terms of atomic ratio). However, since its effect is saturated at about 0.15%, the addition beyond it is economically meaningless.

Cr also acts to improve hardening and urges generation of a low temperature transformation product which is useful for enhancing strength. Its effect is exhibited when 0.01% Cr or more, preferably 0.03% or more is added. However, since its effect is saturated at 0.5%, the addition beyond it is economically meaningless.

By adding a small amount of either Nb or V, a metal structure is made finer and the strength is enhanced without losing toughness. Further, as in the case of Ti, a small amount of each of them dissolves in ferrite and acts to suppress the bainite transformation in a rapid cooling process. Such an action is effectively exerted when 0.01% or more of each of them is added. However, since its effect is saturated at 0.15%, the addition beyond it is economically meaningless.

Now, the metal structure of the steel material will be described. The steel material of the present invention has a composite structure which consists of ferrite and low temperature transformation phase. The mean grain size of the low temperature transformation phase is 3.0 μm or less. Further, grains whose grain size is 3.0 μm or less occupy 50% or more by area ratio of the low temperature transformation phase, and an average aspect ratio is 0.35 or more.

In the present invention, a "low temperature transformation phase" refers to a low temperature transformation structure, that is, martensite, bainite, and pseudo pearlite defined by Araki et al. ("Atlas for Bainite Mircostructures Vol. 1," Jun. 29, 1992, Iron & Steel Institute of Japan, pp. 1-2). Among these low temperature transformation phases, it is preferable that second phases mainly comprising martensite occupy 10% or more to 80% or less by area ratio and, more preferably, 20% or more to 70% or less. Further, in order to obtain a steel sheet of a composite structure with high ductility and workability, it is preferable to allow the martensite structure in the second phase to be 90% or more by area ratio.

The mean grain size of the above low temperature transformation phase must be 3.0 μm or less. At the same time, the grains of 3.0 μm or less must occupy 50% or more by area ratio. If the grains of 3.0 μm or more exceed 50% by area ratio, ductility decreases and sufficient workability cannot be obtained. In order to achieve both the strength and workability, the more preferable low temperature transformation phase should have a mean grain size of 2.5 μm or less and the grains whose grain size is 3.0 μm or less occupy 65% by area ratio.

Furthermore, an average aspect ratio of the low temperature transformation phase must be 0.35 or more. If it is less than 0.35, ductility is not enough and sufficient workability cannot be obtained. A preferred aspect ratio is 0.45 or more, and more preferably 0.55 or more.

Figure 2A:
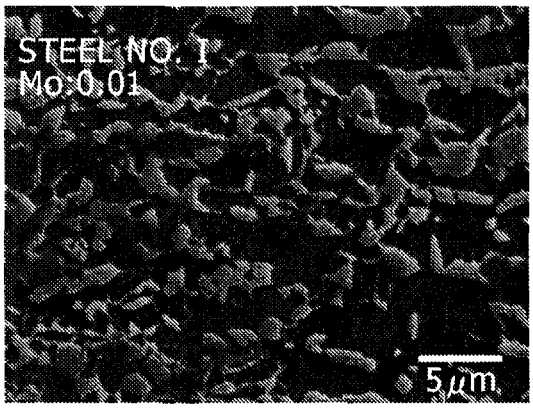
FIG. 2 shows pictures (2000 magnifications) of cross sections of structures of steel sheets obtained from the test example.
Figure 2B:
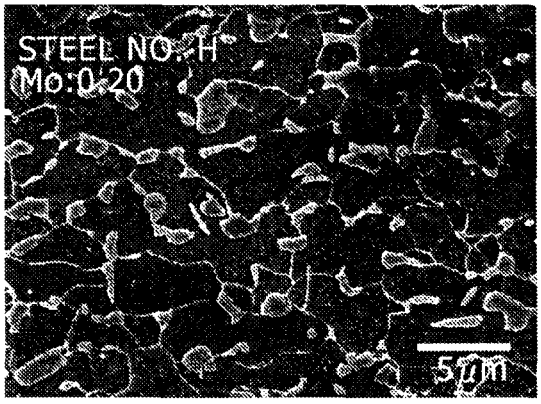
Figure 2C:
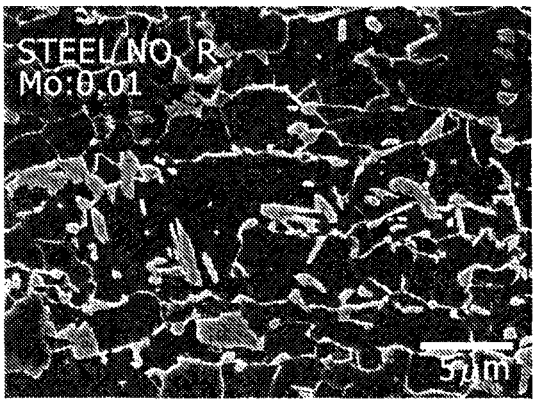

The grain size and aspect ratio of the above-described low temperature transformation phase are found in the following manner. For example, as shown in FIGS. 2A, 2B, and 2C, a cross section in the direction of L of a test steel plate is sampled by a resin embedding method. Further, five views of each sample at a t/4 position (t: thickness of the sheet) of the cross section is photographed by a scanning electron microscope (trade name "JSM-6100," made by JEOL, Ltd.) under the magnification of 2000. Then, each photograph is examined by an image analyzer (trade name "LUZEX-F," made by NIRECO Corporation) to find a grain size and an aspect ratio (short diameter/long diameter ratio) of the second phase (low temperature transformation phase).

The grain size here (in the case of finding an aspect ratio, long diameter) refers to the maximum length between given two points on the circumference of each second phase appearing in each image. Further, a short diameter refers to the shortest distance between two points when the image of the transformation phase is sandwiched between two lines parallel to the above maximum length. Further, when two or more second phases are connected, they shall be separated at an intermediate point of a connection portion to find the short and long diameters. As for the aspect ratio, 80 or more pieces of data (70% or more of the picture) per one view of each picture were extracted to find the mean value.

The grain size and a dispersed state of the low temperature transformation phases referred to in the present invention differ from those of the carbide in balling-up annealing seen in the case of a common high carbon steel. Balling-up (of the carbide) and workability of the carbide are described, for example, in JP-A No. 2003-147485 and JP-A No. 2-259013. However, these are the techniques for improving die-cutting workability for high carbon steel. Therefore, they are fundamentally different from the improvement technique of the present invention for the press-forming feature to be applied to the structural member of the automobile with respect to the low-carbon steel to which the present invention is directed.

There is no particular restriction to the manufacturing conditions for obtaining the grain size and aspect ratio of the above-described low temperature transformation phase specified in the present invention. Therefore, what is necessary is to properly control the heating temperature, heating rate, holding temperature, cooling start temperature, cooling rate, etc. in a general manufacturing steps of a steel sheet, such as steps from continuous casting to continuous annealing through hot-rolling, pickling, and cold-rolling. In the case of a hot-dip galvanized steel sheet or an alloyed hot-dip galvanized steel sheet, what is necessary is just to perform proper temperature control including a continuous hot-dip galvanizing line. However, what become most important when securing preferable quality of the low temperature transformation phase are heating conditions and soaking conditions in the continuous annealing after the hot-rolling and cold-rolling, and subsequent cooling conditions and tempering conditions. Hereafter, these heat treatment conditions will mainly be described.

Secondary Heating after Hot-Rolling:

According to the present invention, C and N necessary for stabilizing austenite are allowed to be thickened enough in an austenite phase to promote fine depositing of a low temperature transformation phase without reducing productivity. For that purpose, after heating (primary heating) to 200 to 700° C. at a rate of 2 to 5° C./s, it is preferable to heat to 780° C. or more (secondary heating) at a rate of 1 to 2° C./s. It is possible to adopt the primary heating for heating at a fixed rate. However, if the above secondary heating method is adopted, thickening of C or N can be made more efficiently in a short time.

Soaking in Dual-Phase Region (Ferrite and Austenite Beyond $Ac_1$ Point):

In order to reliably obtain a composite structure comprising ferrite and martensite, which is a principal low temperature transformation phase, it is preferable to perform heating to 780° C. or more. Although there is no particular upper limit for the heating temperature, in order to prevent the austenite grain from becoming larger and to reduce the grain size of the low temperature transformation phase, it is preferable to suppress the temperature to 900° C. or less. That is, it is preferable to perform soaking between 780 and 900° C. corresponding to the dual-phase region (ferrite and austenite beyond $Ac_1$ point). The holding time is not particularly restricted. However, enough soaking is performed with holding of one minute or more. The preferable holding time for obtaining the dual-phase structure of ferrite and austenite is about three to five minutes. The holding time of ten minutes or more is not necessary.

Cooling after Soaking:

In order to efficiently generate a prescribed low temperature transformation phase in the cooling after the above soaking, it is preferable to cool (primary cooling) between the soaking temperature and the temperature of 500 to 700° C. at an average cooling rate of 2° C./s or more. Subsequently, it is preferable to cool (secondary cooling) to a prescribed cooling stop temperature (Ts: about 60° C. or less) at a rate of 50 to 2000° C./s. If the rate of the primary cooling is less than 2° C./s, the cooling takes time, which is disadvantageous also in terms of equipment and productivity. Therefore, it is preferred to cool at 5° C./s or more. Further, when the temperature during the primary cooling exceeds 700° C., there is a possibility that all the structure may become martensite and ductility may be deteriorated extremely. Alternatively, when the temperature is less than 500° C., the share of the martensite becomes less than 10% by area ratio, being unable to achieve the object of increasing the strength.

Moreover, when the secondary cooling rate is less than 50° C., it becomes difficult to obtain a favorable composite structure of ferrite phases and low temperature transformation phases. Also, problems such as control of steel plate temperature and equipment cost arise. There is no particular upper limit for the secondary cooling rate. However, considering an actual operation, about 2000° C./s may be an upper limit.

Tempering:

When the soaking and the cooling according to the above condition are over, it is preferable to raise the temperature in a range between 100° C. or more and 550° C. or less at the rate of 0.5 to 4° C./s to perform tempering. It is not recommendable, in respect of productivity, to hold down the heating rate at this time to 0.5° C./s or less. Also, when the temperature is less than 100° C., the purpose of tempering cannot be achieved. Further, when the temperature exceeds 550° C., the balance of tensile strength and elongation will fall remarkably. One minute or more of the holding time for tempering is enough. However, in order to ensure the tempering, five minutes or more is preferred. A holding time of ten minutes or more is completely meaningless. After the tempering, the steel sheet may be cooled at about 1° C./s or more in consideration of productivity. Though there is no particular upper limit, up to about 250° C./s may be appropriate.

According to the present invention, there is provided a high strength steel sheet useful for an automobile etc., which has a high strength of 590 MPa or more and, further, 980 MPa or more while securing high workability through properly controlling the form of the low temperature transformation phase by using the steel material whose chemical compositions are specified as above and by adopting proper heating conditions including the cooling condition and holding condition.

EXAMPLES

Now, the present invention will be described more specifically by referring to test examples. The present invention is not restricted in itself by the following test examples. Therefore, it is possible to carry out the invention by properly modifying the examples within the above described or later describe spirit of the invention, and such modifications are all to be included in the technical scope of the present invention.

TEST EXAMPLE

A steel material of the composition as shown in Table 1 was melted, and then cast into slabs by continuous casting. The slabs were held at 1150° C. or 1250° C., hot-rolled at a finishing temperature of 800 to 950° C. into 2.6 mm in thickness, and then coiled at 480° C., thereby hot-rolled steel sheets were produced. The hot rolled steel sheets were pickled, cold rolled at the rate of 56% into 1.2 mm in thickness and, on the conditions shown in Table 2, they were subjected to continuous annealing in a continuous annealing line or a continuous hot-dip galvanizing line, thereby steel sheets were produced. In Table 2, steel Nos. 1 to 11 are cold-rolled steel sheets and steel Nos. 12 to 17 are hot-dip galvanized steel sheets. Steel Nos. 18 to 26 are comparative examples which do not have proper steel material compositions or whose manufacturing conditions are not proper and the metal structure lacks the prescribed requirements.

With respect to each of the steel sheets thus obtained, by using JIS No. 5 test piece, a tensile test was carried out to measure tensile strength (TS) and elongation (El) to find a balance (TS×El) of tensile strength and elongation.

L-direction cross sections of metal structures were prepared as samples by a resin embedding method. Then, with respect to a t/4 position of the L cross section, five views of each sample were photographed at 2000 magnifications by a scanning electron microscope (trade name "JSM-6100," made by JEOL, Ltd.). Then, each picture was examined by an image analyzer (trade name "LUZEX-F," made by NIRECO Corporation) to find the grain size and aspect ratio (short diameter/long diameter ratio) of the second phase (low temperature transformation phase). The grain size (in calculating an aspect ratio, long diameter) referred to here means a maximum length between given two points on a circumference of the second phase shown in each image. Also, the short diameter means the shortest distance between two points when the image of the transformation phase is sandwiched by two lines parallel to the above maximum length. As for the aspect ratio, 80 pieces or more (70% or more of the picture) of the data per one view of each picture were extracted and the mean value thereof was found.

Table 2 collectively shows manufacturing conditions, tensile strength characteristics of obtained steel sheets, mean grain sizes of low temperature transformation phases, and the aspect ratios (short diameter/long diameter ratios).

TABLE 1

| Steel | Chemical composition (mass %, Remainder: Fe) | | | | | | | | | | | |
|---|---|---|---|---|---|---|---|---|---|---|---|---|
| No. | C | Si | Mn | P | S | Al | Cr | Mo | N | Ti | Nb | V |
| 1 | 0.085 | 0.75 | 1.99 | 0.010 | 0.004 | 0.04 | 0.02 | 0.03 | 0.004 | | | |
| 2 | 0.095 | 0.63 | 2.3 | 0.010 | 0.004 | 0.04 | 0.02 | 0.10 | 0.004 | 0.030 | | |
| 3 | 0.145 | 0.55 | 2.2 | 0.010 | 0.004 | 0.03 | 0.03 | 0.20 | 0.004 | | 0.011 | |
| 4 | 0.064 | 0.65 | 1.61 | 0.010 | 0.002 | 0.05 | 0.02 | 0.01 | 0.005 | | | |
| 5 | 0.085 | 0.65 | 1.65 | 0.019 | 0.001 | 0.04 | 0.03 | 0.20 | 0.006 | | | |
| 6 | 0.143 | 1.32 | 1.78 | 0.018 | 0.004 | 0.07 | 0.07 | 0.15 | 0.004 | 0.02 | | |
| 7 | 0.125 | 1.75 | 2.27 | 0.014 | 0.001 | 0.06 | 0.15 | 0.03 | 0.006 | 0.03 | | |
| 8 | 0.105 | 1.38 | 2.02 | 0.010 | 0.003 | 0.04 | 0.04 | 0.01 | 0.004 | | | |
| 9 | 0.053 | 0.55 | 1.20 | 0.022 | 0.002 | 0.07 | 0.01 | 0.20 | 0.005 | | | 0.05 |
| 10 | 0.099 | 1.2 | 2.1 | 0.010 | 0.003 | 0.03 | 0.03 | 0.20 | 0.004 | | | |
| 11 | 0.170 | 0.96 | 1.70 | 0.015 | 0.002 | 0.06 | 0.31 | 0.10 | 0.007 | 0.05 | | |
| 12 | 0.085 | 1.03 | 2.01 | 0.015 | 0.002 | 0.06 | 0.11 | 0.05 | 0.007 | | | |
| 13 | 0.124 | 1.81 | 1.53 | 0.015 | 0.001 | 0.05 | 0.07 | 0.17 | 0.006 | 0.07 | 0.03 | |
| 14 | 0.063 | 0.91 | 2.45 | 0.021 | 0.001 | 0.09 | 0.27 | 0.03 | 0.005 | | | |
| 15 | 0.041 | 0.51 | 1.63 | 0.014 | 0.002 | 0.06 | 0.24 | 0.15 | 0.006 | | | |
| 16 | 0.055 | 0.51 | 1.95 | 0.015 | 0.005 | 0.05 | 0.02 | 0.15 | 0.004 | 0.025 | | |
| 17 | 0.161 | 1.21 | 2.02 | 0.010 | 0.003 | 0.03 | 0.19 | 0.01 | 0.004 | | | |
| 18 | 0.061 | 0.61 | 1.61 | 0.010 | 0.004 | 0.03 | 0.02 | 0.01 | 0.004 | | | |
| 19 | 0.030 | 0.85 | 2.76 | 0.021 | 0.002 | 0.09 | 0.26 | 0.03 | 0.005 | | | |
| 20 | 0.024 | 0.88 | 2.07 | 0.015 | 0.005 | 0.05 | 0.05 | 0.20 | 0.006 | 0.01 | 0.05 | |
| 21 | 0.125 | 2.45 | 0.48 | 0.011 | 0.001 | 0.05 | 0.11 | 0.20 | 0.005 | | | |
| 22 | 0.176 | 1.35 | 2.02 | 0.010 | 0.003 | 0.03 | 0.02 | 0.01 | 0.004 | | | |
| 23 | 0.096 | 0.59 | 2.02 | 0.018 | 0.004 | 0.08 | 0.03 | 0.19 | 0.005 | 0.16 | | |
| 24 | 0.092 | 2.80 | 1.52 | 0.018 | 0.002 | 0.03 | 0.31 | 0.20 | 0.004 | | | |
| 25 | 0.134 | 0.12 | 2.23 | 0.015 | 0.001 | 0.07 | 0.21 | 0.30 | 0.006 | | | |
| 26 | 0.201 | 0.65 | 1.70 | 0.013 | 0.001 | 0.10 | 0.17 | 0.23 | 0.006 | | | |

TABLE 2

| | Mechanical properties | | | Manufacturing conditions | | | | |
|---|---|---|---|---|---|---|---|---|
| Steel No. | TS (MPa) | El (%) | TS × El (MPa %) | Primary heating (° C./s) | Secondary heating (° C./s) | Soaking temperature (° C.) | Soaking time (sec.) | Primary cooling (° C./s) |
| 1 | 811 | 21.5 | 17468 | 2 | 2 | 820 | 245 | 7.4 |
| 2 | 1000 | 16.9 | 16945 | 3 | 2 | 815 | 268 | 8.2 |
| 3 | 1192 | 9.6 | 11386 | 3 | 2 | 830 | 273 | 8.6 |
| 4 | 617 | 27.8 | 17164 | 3 | 2 | 822 | 270 | 8.1 |
| 5 | 805 | 21.1 | 16964 | 3 | 2 | 819 | 265 | 7.2 |

TABLE 2-continued

| | | | | | | | | |
|---|---|---|---|---|---|---|---|---|
| 6 | 999 | 17.1 | 17120 | 4 | 2 | 842 | 251 | 7.9 |
| 7 | 1213 | 9.8 | 11885 | 3 | 2 | 830 | 238 | 7.6 |
| 8 | 1020 | 16.4 | 16728 | 3 | 2 | 822 | 278 | 8.0 |
| 9 | 610 | 28.8 | 17597 | 2 | 2 | 825 | 259 | 2.0 |
| 10 | 1019 | 16.2 | 16525 | 3 | 2 | 839 | 244 | 8.9 |
| 11 | 1187 | 9.1 | 10802 | 5 | 2 | 804 | 237 | 7.3 |
| 12 | 808 | 22.4 | 18129 | 4 | 2 | 851 | 226 | 5.2 |
| 13 | 1036 | 16.3 | 16845 | 3 | 2 | 846 | 248 | 6.8 |
| 14 | 1041 | 16.4 | 17042 | 3 | 2 | 830 | 263 | 7.3 |
| 15 | 616 | 28.6 | 17613 | 3 | 2 | 821 | 285 | 8.1 |
| 16 | 822 | 20.9 | 17133 | 2 | 2 | 815 | 214 | 6.9 |
| 17 | 1142 | 8.5 | 9437 | 2 | 2 | 842 | 269 | 7.4 |
| 18 | 624 | 23.5 | 14653 | 0.8 | 2 | 835 | 265 | 6.2 |
| 19 | 993 | 12.5 | 12421 | 3 | 2 | 821 | 241 | 7.4 |
| 20 | 787 | 17.2 | 13516 | 4 | 2 | 814 | 278 | 7.1 |
| 21 | 514 | 18.0 | 9268 | 5 | 2 | 809 | 264 | 7.3 |
| 22 | 1018 | 13.8 | 14045 | 2 | 0.9 | 851 | 275 | 7.6 |
| 23 | 1215 | 7.3 | 8819 | 2 | 2 | 864 | 241 | 8.1 |
| 24 | 844 | 15.7 | 13259 | 2 | 2 | 823 | 235 | 6.9 |
| 25 | 1241 | 6.6 | 8206 | 2 | 2 | 870 | 256 | 7.5 |
| 26 | 1200 | 7.2 | 8596 | 2 | 2 | 834 | 248 | 6.8 |

| | Manufacturing conditions | | | Low temperature transformation phase | | |
|---|---|---|---|---|---|---|
| Steel No. | Secondary cooling start temperature (° C.) | Secondary cooling (° C./s) | Tempering temperature (° C.) | Mean grain size (μm) *1 | Ratio *2 (%) | Aspect ratio d1/d2 |
| 1 | 584 | 1000 | 206 | 2.7 | 65 | 0.49 |
| 2 | 576 | 1200 | 190 | 2.4 | 70 | 0.61 |
| 3 | 582 | 1450 | 250 | 2.7 | 67 | 0.48 |
| 4 | 541 | 1000 | 300 | 2.8 | 54 | 0.38 |
| 5 | 612 | 850 | 215 | 2.9 | 68 | 0.48 |
| 6 | 632 | 950 | 180 | 2.4 | 68 | 0.59 |
| 7 | 587 | 1050 | 202 | 2.3 | 71 | 0.55 |
| 8 | 614 | 1000 | 194 | 2.8 | 58 | 0.39 |
| 9 | 627 | 1300 | 216 | 2.6 | 71 | 0.47 |
| 10 | 561 | 1150 | 271 | 2.6 | 70 | 0.47 |
| 11 | 534 | 1250 | 215 | 2.8 | 65 | 0.48 |
| 12 | 578 | 61 | 549 | 2.5 | 70 | 0.55 |
| 13 | 594 | 51 | 545 | 2.3 | 74 | 0.62 |
| 14 | 564 | 53 | 531 | 2.9 | 66 | 0.43 |
| 15 | 586 | 58 | 548 | 2.7 | 65 | 0.47 |
| 16 | 557 | 64 | 546 | 2.4 | 67 | 0.60 |
| 17 | 594 | 69 | 547 | 2.9 | 51 | 0.39 |
| 18 | 581 | 890 | 203 | 3.1 | 48 | 0.29 |
| 19 | 524 | 1050 | 204 | 3.2 | 48 | 0.43 |
| 20 | 624 | 64 | 540 | 2.9 | 48 | 0.43 |
| 21 | 561 | 1150 | 216 | 3.5 | 51 | 0.46 |
| 22 | 556 | 1200 | 208 | 3.2 | 54 | 0.29 |
| 23 | 573 | 1050 | 207 | 2.5 | 60 | 0.35 |
| 24 | 564 | 950 | 206 | 3.4 | 58 | 0.33 |
| 25 | 572 | 58 | 315 | 2.5 | 60 | 0.31 |
| 26 | 512 | 1300 | 255 | 3.8 | 35 | 0.29 |

*1 Mean value of maximum length between given two points on circumference of low temperature transformation phase's image

*2 Ratio of low temperature transformation phases with grain size of 3.0 μm or less to all low temperature transformation phase The followings are conceivable from Tables 1 and 2.

Steel Nos. 1 to 17 are examples which conform to all the requirements set by the present invention. It is seen that when tensile strength levels are 590 MPa, 780 MPa, 980 MPa, and 1180 MPa, elongation rates are 27.5% or more, 20.8% or more, 16% or more, and 9% or more, respectively, showing excellent balance of tensile strength and elongation.

On the other hand, as comparative examples, steel Nos. 18 to 26 lack any one of the requirements specified by the present invention, and any one of the target performance characteristics is not sufficient as shown below.

The amount of Mn contained in steel No. 19 exceeds the prescribed range. Therefore, even though a high strength is obtained, grain sizes of the low temperature transformation phase are widely dispersed and the mean grain size exceeds the prescribed value, being unable to achieve sufficient ductility. Steel No. 20 lacks the amount of C. Therefore, the strength of the low temperature transformation phase is not sufficient. Its ductility is poor as compared to strength, and the steel lacks the balance of tensile strength and elongation. Steel No. 21 lacks the enough amount of Mn. Therefore, solid solubility reinforcement is not enough and sufficient strength is not obtained. Further, the mean grain size of the low temperature transformation phase is large and ductility is poor. Steel No. 22 satisfies the prescribed requirements of chemical compositions. However, of the manufacturing conditions, the secondary heating temperature is not appropriate. Therefore, the grain size of the low temperature transformation phase is coarse. Further, its aspect ratio has not reached the prescribed value. Therefore, its ductility is low and the balance of tensile strength and elongation is poor.

Steel No. 23 contains too much amount of microalloy elements such as Ti. Therefore, though it has a high strength, carbides have deposited in large quantities in the grain area, and the ductility is greatly lowered. The amount of Si contained in steel No. 24 exceeds the prescribed range. Therefore, the volume fraction of ferrite becomes too high and enough strength is not obtained. Steel No. 25 lacks enough amount of Si. Therefore, the aspect ratio of the low temperature transformation phase has not reached the prescribed value. Accordingly, the ductility is remarkably poor and the balance of tensile strength and elongation is poor. Steel No. 26 contains too much amount of C. Therefore, the volume fraction of the low temperature transformation phase becomes too high, causing too much hardening. Thus, the ductility is remarkably lowered and the spot-weldability becomes very poor.

Steel No. 18 has substantially the same composition as that of steel No. 4. However, the primary heating condition while the steel is manufactured is not appropriate. Therefore, the mean grain size of the low temperature transformation phase exceeds the prescribed value and the aspect ratio is also low. Thus, as compared to steel No. 4, the balance of tensile strength and elongation is poor.

FIG. 1 is a graph showing an effect on the balance of tensile strength and elongation (TS×El) and aspect ratio of the low temperature transformation phase given by the amount of Mo added to the test steel material based on the test data shown in Tables 1 and 2. As clearly seen from the graph also, considerable non-uniformity is observed according to a target strength level. However, when a small amount of Mo is added in a range of 0.02 to 0.2%, the aspect ratio of the low temperature transformation phase shows a comparatively high value. Possibly, because of this, TS×El balance also shows a high value in the Mo added region. However, when the added amount of Mo exceeds 0.20%, it is found that such an effect is decreased considerably.

FIG. 2 shows pictures (magnification of 2000) of cross sections of structures of the steels obtained in the above examples. FIG. 2A shows steel No. 8 (Example of the invention), FIG. 2B shows steel No. 9 (Example of the invention), and FIG. 2C shows steel No. 18 (Comparative example). In these pictures, island-like white objects are low temperature transformation phases, and cord-like thin objects are ferrite grain areas.

As is clear when comparing these pictures, in the examples of the present invention in FIGS. 2A and 2B, as compared to Comparative example in FIG. 2C, the sizes of low temperature transformation phases are short and substantially uniform as a whole and are uniformly dispersed all over. Further, between FIGS. 2A and 2B, there is a considerable difference in percentage by area ratio of the low temperature transformation phases. This percentage by area ratio can be adjusted particularly by the cooling condition after heating. When a high strength is asked for, what is necessary is to increase the volume fraction of the low temperature transformation phases by comparatively adopting the rapid cooling condition. When the workability is highly thought of, the rapid cooling condition may be eased and the volume fraction of the low temperature transformation phase may comparatively be suppressed low.

The invention claimed is:

1. A high strength steel sheet comprising

C: 0.03 to 0.20% (% by mass in chemical compositions; hereafter, the same holds true), Si: 0.50 to 2.5%, and Mn: 0.50 to 2.5%, wherein a metal structure includes ferrite and low temperature transformation phase, a mean grain size of the low temperature transformation phase is 3.0 μm or less, grains having a grain size of 3.0 μm or less occupy 50% or more by area ratio of the low temperature transformation phase, and an average aspect ratio of the low temperature transformation phase is 0.35 or more, wherein the steel sheet has a tensile strength of 780 MPa or more, wherein the steel sheet is a cold rolled steel sheet, and wherein the low temperature transformation phase contains martensite, bainite and pseudo pearlite.

2. A high strength steel sheet according to claim 1, further containing 0.02 to 0.2% Mo.

3. A high strength steel sheet according to claim 1, further comprising at least one element selected from the group consisting of Ti: 0.01 to 0.15%, Nb: 0.01 to 0.15%, Cr: 0.01 to 0.5%, and V: 0.001 to 0.15%.

4. A high strength steel sheet according to claim 1, which contains 0.05% to 0.17% of C.

5. A high strength steel sheet according to claim 1, which contains 0.7 to 1.8% of Si.

6. A high strength steel sheet according to claim 1, which contains 0.50% to 2.3% of Mn.

7. A high strength steel sheet according to claim 1, wherein the low temperature transformation phase contains martensite occupying 10% to 80% by area ratio.

8. A high strength steel sheet according to claim 1, wherein the low temperature transformation phase contains martensite occupying 20% to 70% by area ratio.

9. A high strength steel sheet according to claim 1, wherein the low temperature transition phase contains martensite in 90% or more by area ratio.

10. A high strength steel sheet according to claim 1, wherein the mean grain size of the low temperature transformation phase is 2.5 μm or less.

11. A high strength steel sheet according to claim 1, wherein grains having a grain size of 3.0 μm or less occupy 65% or more by area ratio of the low temperature transformation phase

12. A high strength steel sheet according to claim 1, wherein the average aspect ratio of the low temperature transformation phase is 0.45 or more.

13. A high strength steel sheet according to claim 1, wherein the average aspect ratio of the low temperature transformation phase is 0.55 or more.

14. A high strength steel sheet according to claim 1, which has a tensile strength of 1180 MPa or more.

15. A high strength steel sheet according to claim 1, which has a tensile strength of 980 MPa or more.

* * * * *